United States Patent [19]

Bolton

[11] Patent Number: 4,980,529

[45] Date of Patent: Dec. 25, 1990

[54] METHOD AND APPARATUS FOR UNIFORM HEATING IN A MICROWAVE FIELD

[76] Inventor: Craig E. Bolton, 14215 Seneca Rd., Germantown, Md. 20874

[21] Appl. No.: 293,058

[22] Filed: Jan. 3, 1989

[51] Int. Cl.[5] ..... H05B 6/78

[52] U.S. Cl. ..... 219/10.55 M; 219/10.55 E; 219/10.55 F; 99/421 V; 99/DIG. 14; 426/243

[58] Field of Search ..... 219/10.55 F, 10.55 E, 219/10.55 R, 10.55 A, 10.55 M, 392, 388; 99/421 R, 421 P, 421 V, 443 R, 451, DIG. 14; 426/241, 243

[56] References Cited

U.S. PATENT DOCUMENTS

| | | | |
|---|---|---|---|
| 3,288,054 | 11/1966 | Weprin et al. | 99/332 X |
| 4,043,260 | 8/1977 | LaPour et al. | 99/421 HV |
| 4,196,221 | 4/1980 | Dew | 99/451 |
| 4,343,979 | 8/1982 | Barbini et al. | 219/10.55 A |
| 4,503,307 | 3/1985 | Campbell et al. | 219/10.55 E |
| 4,652,712 | 3/1987 | Zeipel | 219/10.55 F |

OTHER PUBLICATIONS

Article in National Geographic Magazine, vol. 174, No. 1, p. 32, Jul. 1988.

*Primary Examiner*—Philip H. Leung
*Attorney, Agent, or Firm*—Craig E. Bolton

[57] ABSTRACT

The present invention relates to a method of heating an item in a microwave oven which includes suspending the item by at least one fiber, causing the suspended item to rotate and heating the suspended item while it is rotating.

9 Claims, 2 Drawing Sheets

METHOD AND APPARATUS FOR UNIFORM HEATING IN A MICROWAVE FIELD

TECHNICAL FIELD

This invention relates to heating items such as food in a microwave field. More specifically, it relates to a method and apparatus providing complex three dimensional motion to an item during heating for uniform exposure to a non-uniform microwave energy field, particularly, but not exclusively, for microwave cooking.

BACKGROUND ART

To obtain uniform heating in a microwave oven, it is often desirable to move the food item about within the oven to expose it to regions of different microwave intensity. A well known problem with common household microwave ovens is the nonhomogeneous energy distribution resulting from a complex standing wave pattern that sets up when microwave energy is propagated into the microwave oven cavity. A useful analogy is a light beam entering a mirrored room. The beam reflects and scatters from objects in the room and from the walls of the room and in the process crosses its own path many times. In the case of radiant microwave energy, the wavelength is such that where the waves intersect heating is increased or decreased depending on the relative phases of the respective waves at the points of intersection. Where the phases oppose and waves cancel, heating is decreased and a cold spot results. Where waves reinforce, heating is increased and a hot spot results. Hot and cold spots occur only where absorbing materials convert the different microwave energy densities to corresponding various heating levels. The location of the hot and cold spots depends on the geometry of the oven and the type and position of energy absorbing or reflecting objects placed in the oven.

In attempts to solve the problem, manufacturers of frozen food preparations often include directions recommending that the user perform the inconvenient task of repositioning a food container from time to time during the microwave cooking period. Ovens often include a "mode stirrer" for reflecting and distributing microwave energy more uniformly inside the oven. Various turntables and rotisseries have been developed to rotate the food itself during cooking. Non-removable turn tables and rotisseries have been developed and included during initial manufacture of more expensive oven models. Such rotisseries are generally the least reliable component and add considerably to the cost of a microwave oven. Accordingly, many oven units do not include a means for rotating the food.

Various turntables have been developed for retro-fitting a microwave oven with a removable rotisserie means. Examples of such prior art turntables appear in the following patents:

Beh et al. U.S. Pat. No. 4,254,319 discloses a portable turntable for a microwave oven wherein microwave energy heats a reservoir of water to generate steam that powers a turbine geared to the turntable.

Bowen et al. U.S. Pat. No. 4,434,343 discloses a turn table for a microwave oven which is powered by a wind-up clock motor arrangement.

Park U.S. Pat. No. 4,725,703 discloses a microwave turntable with a cam and gear arrangement for lifting and turning a food item in a microwave oven.

Prior art turntables suffer from complexity and fail to provide in a single unit all the advantages of the present invention. There is a continuing need for a simple, low cost rotisserie that more effectively distributes microwave energy in an absorbing item.

OBJECTS OF THE INVENTION

An object of the present invention is to provide a method and device for moving a food item during microwave cooking.

Another object is to cause the food to transect and bathe in radiation through complex, sometimes irregular and erratic, three dimensional movement within the heating field of a microwave oven thus providing uniform average heating even though the microwave energy is heterogeneously distributed in the active volume of the oven cavity.

Another object is to provide such a device which can be made durable and reusable or alternatively, integral with a food package and disposable.

A further object is to provide such a device which has few parts and is thus less expensive yet more reliable than complex designs serving a similar purpose.

Another object is to provide such a device that continues moving a longer time for more massive food items which require longer cooling times.

Another object is to provide such a device that may contain microwave reflective material to provide an integral primary or secondary mode stirrer.

Another object is to provide such a device that supports an item above the oven floor to reduce conductive heat loss to the floor and thereby reduce required heating time.

A further object is to provide such a device which while offering improved convenience and uniformity of heating is not only simple, inexpensive and efficient, but entertaining, educational, and satisfying.

SUMMARY OF THE INVENTION

The above and other related objects are satisfied in accordance with the invention, by a carrier means for containing the heating load and means for supporting the carrier means apart from the walls of the microwave oven cavity. The supporting mean is capable of guiding the carrier means through a non-planar trajectory in response to an external force applied thereto.

In accordance with a particular embodiment of the invention, the inventive apparatus comprises a fiber with a load carrier means connected to one end of the fiber and means for retaining the opposite end of the fiber within the cavity. The fiber advantageously has a length and the retaining means is located within the cavity such that the carrier means is maintained apart from the cavity walls. This enables the heating load to move about in the cavity, with a complex motion, in response to an applied force, to reduce uneven heating or "hot spots" within the load.

In accordance with a further embodiment of the invention the fiber may be secured to the ceiling of a microwave oven cavity by means of a suction cup.

In accordance with another embodiment, the inventive apparatus includes retaining means for the fiber comprising a support stand located on a lower wall of the cavity and a carrier means comprising a receptacle wherein the receptacle is suspended from an upper portion of the support stand by the fiber.

In accordance with another aspect of the invention, a method is provided for moving a heating load within a microwave cavity while heating comprising the steps of, suspending the heating load in the cavity apart from the cavity walls and, in response to an external force applied to the load, moving the suspended load within the cavity.

GENERAL DESCRIPTION OF THE INVENTION

With this invention, an item to be heated (e.g., a package of frozen food) may be suspended from a point above the floor of a microwave oven by at least one flexible fiber. The suspension enables spinning, swinging, pendulum-like, nutating, and precessional movement of the item. The item will wobble as it spins.

The flexible fiber may be a thread, cord, line, tether or string formed from strong material which may be essentially non-absorbing of microwave energy (e.g., heavy duty woven polyester sewing thread, dental floss, or fishing line). Especially formulated and fashioned polymeric fibers may also be used.

The upper end of the fiber may be secured to the oven ceiling or to a point near the ceiling by any suitable means including a support rod, suction cup, adhesive take or hook. Pendant from the lower end of the fiber is a means of suspending an item to be heated. The suspension means may include a box, a net, a bag, a basket, tongs, clips, weight-actuated jaws that grip the item directly or that engage a planar support surface upon which the item or package rests, or any other suitable means. The item dangles from the ceiling like an artful mobile and is a pleasure to watch as it moves with a peculiar, intriguing and sometimes graceful spinning motion. The precise motion is a challenge to describe. Words such as chaotic, random, pseudo-random, unpredictable, erratic, irregular and haphazard come to mind yet do not seem to justly convey what is observed. The induced pattern of movement is generally idiosyncratic. The complex motion is that which results essentially from the combination and interplay of pendular, nutating and rotary components. The rotary component is preferably dominant.

Initiation of motion of the suspended mass can be achieved by automatically or manually spinning, twisting, pushing, lifting or imparting other impetus. The delicate suspension enables oscillations to continue cycling for a considerable time before decay. It has been found to be particularly advantageous to provide an impetus that causes significant rotation of the mass about the suspension axis. The strength and direction of the impetus can be controlled manually by the operator. If the suspension means includes material that responds to a magnetic or electromagnetic field, initial or repeated impetus may be controlled automatically by a changing field produced for example by a moving permanent magnet or by proximate electromagnetic coils under switch, timer or microprocessor control.

As the suspended mass spins and nutates it twists the fiber into an energy-storing configuration by straining molecular bonds and conformations within the structure of the fiber material. The fiber serves as a torsion spring. However, as the fiber twists it shortens and raises the food or item thus storing additional energy in the form of gravitational potential and furthermore, lifts the item or food mass into another region of the microwave field. Thus motion of the food is not restricted to a single plane as is the case with prior art turntables. The motion can sweep the food through a larger volume of the inhomogeneous radiation field thus sampling and tending to average over the cooking time the various intensities of energy consequently lessening the effects of hot and cold spots. After the spinning mass fully winds the fiber, the fiber unwinds and drives rotation of the suspended item in the opposite direction.

The oscillation process transfers kinetic energy of the rotating mass to potential energy of the twisted fiber, then reverses, passing potential energy of the twisted fiber back to the kinetic energy of the rotating mass when the fiber recoils. This action provides slow mechanical oscillations ideally suited for moving food through a non-uniform microwave field. When a spinning package containing frozen food thaws, its center of mass tends to relocate as liquids flow to different regions inside the package. This weight shift may introduce a beneficial perturbation to the complex pendular motion.

The total duration of the oscillation depends, among other factors, on the weight of the suspended mass, its distribution away from the rotation axis and the dimensions and properties of the suspending fiber. In any case, erratic oscillations begin decay from the moment the initial driving force is released. If no additional impetus is provided, oscillatory movement persists for from 8 to 50 minutes—which for many popular servings and recipes is ample time for complete cooking. One particularly synergistic feature of the present invention is that heavier food items which tend to require longer cooking times tend to oscillate for longer periods.

To provide additional impetus or driving force automatically during the cooking cycle, a swinging sealed food package may be provided with at least one vent hole positioned to provide a thrust vector jet propelling pendular motion. If the food item is not packaged in a sealed envelope, a separate fluid containing vessel or chamber may be suspended along with the food item to provide auxiliary thrust when its contents become heated through microwave energy absorption, vaporize, and exhaust through a properly sized, appropriately positioned vent.

The propulsion field is generally preferably water but may include a relatively low toxicity low vapor pressure fluid such as ethyl alcohol, a water azeotrope thereof or various other solutions. Lower vapor pressure working field provides thrust at a lower temperature and thus earlier during the cooking cycle. For thrust later in the cooking cycle, solutions of salts, sugars, fats, oils and various other non-toxic compounds may be provided as or with the working fluid for raising the boiling point and temperature of the working fluid.

Alternatively, magnetic or electromagnetic driving means may be employed to provide additional impetus to the suspended item during the cooking cycle.

The fiber may be provided with a swivel link to accommodate fiber rotation beyond the point at which the fiber can further twist in one direction.

The fiber may be tied around a cutting edge so that when it twists fully in one direction and tightens around the cutting edge, it is severed thus allowing the food to fall, to actuate a switch that shuts down the magnetron, or through a trap delivery door in a vending machine. The fiber may be secured in a notch and threaded over a supporting edge in such a way that when it twists sufficiently it begins to roll or creep along the edge so that it can travel to the end of the edge and release.

Ancillary non-food materials including the fiber, the food support, and the fiber support structure may be transparent to or reflective of microwave energy. Although, it may be desirable to include absorbing materials for browning purposes or for cooking popcorn, the materials are preferably predominately non-absorbing of microwave energy. Transparent materials include a variety of plastics such as acrylic, cross-linked polyethylene or polystyrene and many other plastics common to the microwave cooking industry. Reflective materials include metals such as iron, steel and aluminum. If metals are used they should be formed to a thickness sufficient to withstand induced currents and smooth with few sharp edges to avoid excessive heating and should be coated with a dielectric to prevent arcing and to maintain the integrity of the reflecting surface, as is known in the art.

The above and still further objects, features and advantages of the present invention will become apparent upon consideration of the following detailed description of one specific embodiment thereof, especially when taken in conjunction with the accompanying drawings.

DETAILED DESCRIPTION OF THE DRAWINGS

Figure 1:
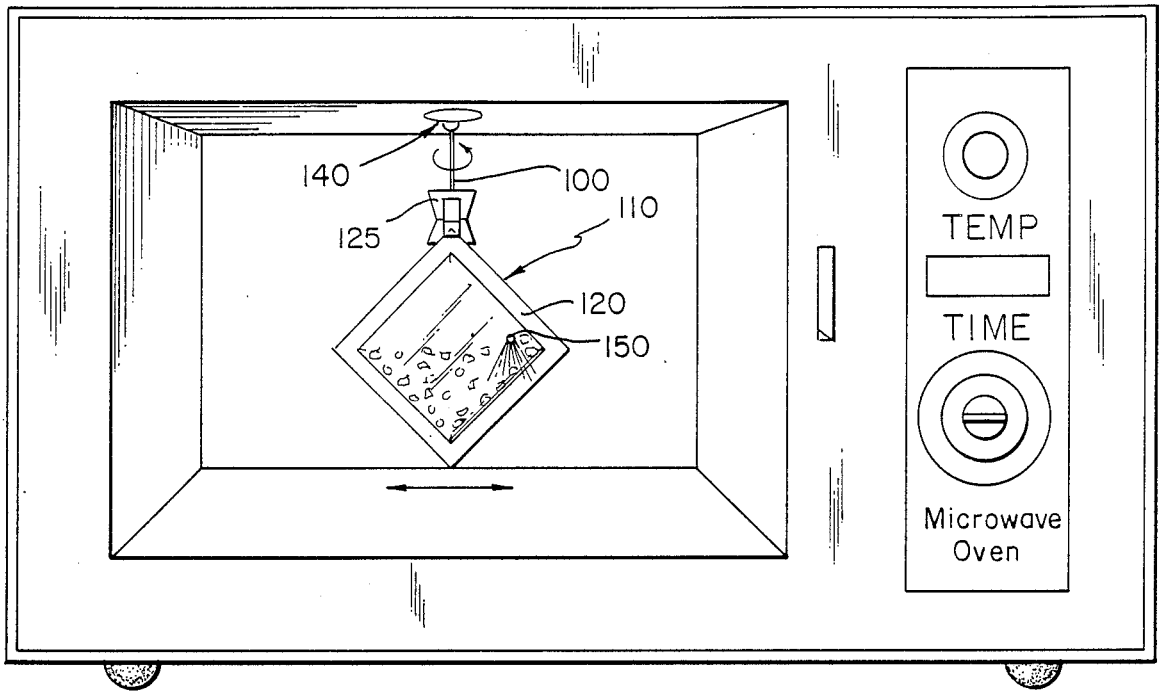
FIG. 1 is a front view of the interior of a microwave oven containing a tethered clip for suspending a frozen food bag according to a preferred embodiment of this invention.

Referring to FIG. 1, a fiber 100 is shown suspending a heating load, such as a sealed plastic food bag 110, from a point along its peripheral seam 120. The fiber may be attached as shown at one corner of the bag or at some other convenient point along the seam, e.g., at the midpoint along the length of one of the seam edges. The fiber may be attached to the bag by any suitable means including; taping, tying, clipping, clamping, sewing, gluing, welding, etc. A clip 125 of the type included with skirt hangers manufactured by Lee Rowan Co. of 6333 Etzel Ave. St. Louis, Mo. 63133 (U.S. Patent No. D 276,967) forms the attachment means shown in FIG. 1. Such a clip is formed entirely of plastic (including the spring) and has been found to be substantially non-absorbing of microwave energy. Some metal clips or plastic clips having thin metal springs may not be suitable for use with the present invention because thin metal portions of the spring or clip may not tolerate the induced currents. They may become hot very quickly, and may melt the polymer material of the fiber or food bag.

The upper end of the fiber may be secured by any suitable means to a point located above the floor of a microwave oven. For example, the upper end of the fiber may be secured to the ceiling of a microwave oven by a vinyl or silicon rubber suction cup 140. Although vinyl suction cups have been observed to perform well during 5 to 10 minute full power tests, clear silicone rubber may be preferred because it appears to be less absorbing than clear vinyl. The type and proportion of polymer additives such as pigments and fillers can greatly influence the microwave absorption characteristics of a particular polymer blend. Polyethylene adhesive tape has also been observed to provide a suitable means of securing the tether. If tape is used the fiber should depend from the center of a small patch of tape to avoid peeling of the tape during the cooling process.

When the food bag is suspended as shown in FIG. 1, it can swing with a complex oscillating motion resulting primarily from a combination of rotary and pendular motions. A light push or twist will initiate respective pendular or rotary oscillations. The initial impetus preferably imparts a combined motion having a significant rotary component that twists the fiber while moving the food through different areas of the microwave field. After the fiber fully winds it recoils and drives food rotation in the opposite direction. As frozen food thaws, fluids flow to different positions within the bag. This re-distribution of mass may cause a spontaneous perturbation in the nutating movement of the bag.

Toward the end of the cooking cycle, when the amplitudes of initial mechanical oscillations have diminished somewhat, water and other fluids inside the bag begin to vaporize vigorously producing steam and gas that expands and pressurizes the food bag. The bag inflates until vapor exhausts through a vent hole 150 either formed in the bag during manufacture or deliberately pierced by the user. The vent is preferably located well away from the suspension axis to provided a tangential thrust with maximum torque for rotating the food bag; it should be positioned toward the top of the bag to avoid spillage of bag contents via the vent hole. The vent hole may be opened prior to cooking by puncturing or by touching the bag with the tip of a hot wire. The relative area of the vent opening in relation to the enclosed volume of the bag it an important consideration for obtaining sufficient thrust. For a 10 ounce bag of frozen corn a vent hole having a diameter of about 1 millimeter has been observed to provide a suitable thrust. The vent may be adapted for automatic opening in response to pressure build-up inside the bag or to heating of an absorbing spot, for example.

As additional advantage of suspending the food above the floor is that conductive heat loss to the floor is minimized.

SUSPENDED BOX

Figure 2:
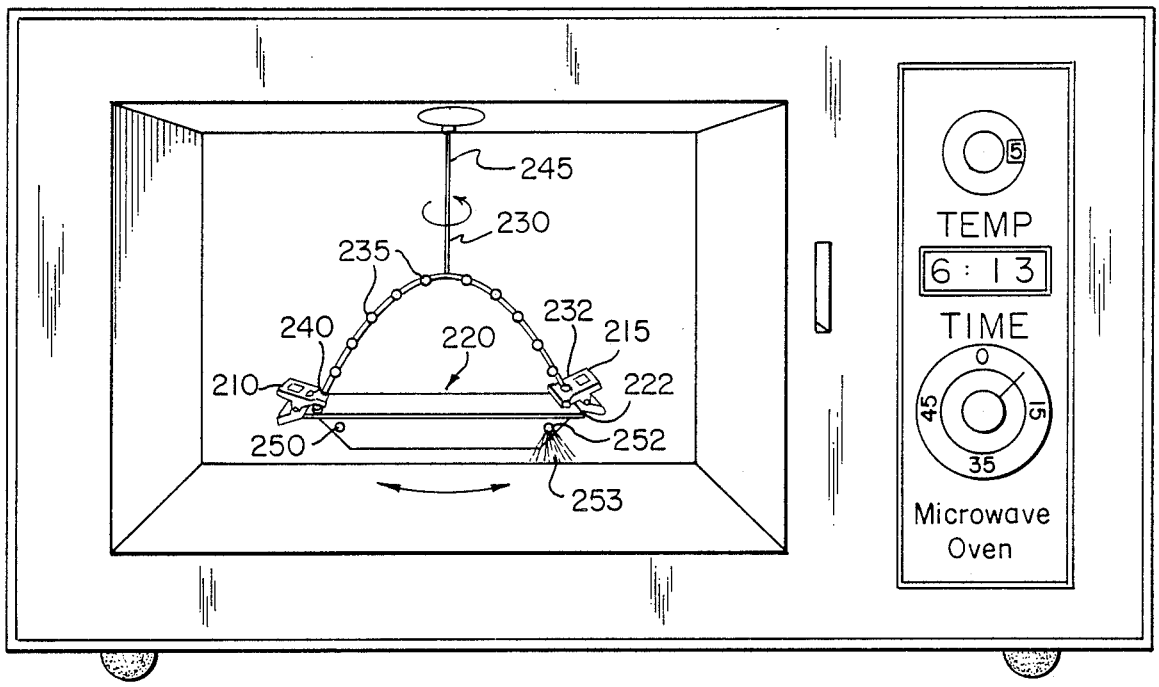
FIG. 2 illustrates a second embodiment of the invention wherein a pair of clips engage a frozen food box.

In accordance with another embodiment as best seen in FIG. 2, two plastic clips are provided for supporting a flat box approximately horizontally. A pair of plastic clips 210 and 215 of the type earlier described are affixed to either end of sealed food box 220 by gripping, for example, a peripheral seam 222. One type of box which is particularly suitable for use with the present invention is the Westvaco TM box for packaging The Budget Gourmet TM line of frozen meals by The All American Gourmet Co. of Orange, Calif. This type of box is sealed in such a way that it can contain considerable internal pressure and so provide a useful thrust for rotating the box. The clips are connected together by a heavy gauge polymeric line 230 which may be a flexible nylon or polyethylene rod, tube, cord or fiber. Line 230 may be threaded through holes 232 located near the box engaging jaws of each clip.

The length of the line 230 may be fixed or it may be adjustable to accommodate various box sizes. To enable length adjustment, the line may be formed with spaced beads 235 which are adapted for interlocking engagement with a slot structure 240 formed radially of the holes, for example. Alternatively, line 230 may have a diameter adapted for friction-fit engagement with the through holes. Many other similar arrangements for line length adjustment may also be used.

The lower end of suspension fiber 245 may be tied around the midpoint of line 230 and may be slid toward either clip to balance or set a horizontal or other preferred angle to the suspended box. The upper end of fiber 245 may be secured to a point located above the floor by any suitable means.

A vent hole indicator in the form of a small circuit 250 may be provided near one upper corner of the box side wall to indicate a location and diameter for puncturing a suitable thrust vent. A one or two millimeter hole of the type resulting from puncture with the tip of a ball point pen has been found to provide the required thrust. The vent hole may be adapted to open automatically in response to internal pressure build-up or heating, for example.

The two-clip arrangement supports the box in a generally horizontal position and provides a compact system that better accommodates low ceiling-height ovens. When it is suspended in the manner described, the box when pushed will gyrate with erratic rotary and pendular motion ideal for uniform cooking. Toward the end of the cooking cycle, gas or vapor 253 rushes from the vent hole 252 and provides additional thrust for continued motion.

Suspension Support

For microwave ovens having a ceiling not suitable for suction cup or adhesive tape fiber attachment, an independent fiber support structure may be desired. For food items not packaged in a sealed bag or box, a means of suspending a variety of food items may be required. The following structures are examples of devices addressing such needs.

Figure 3:
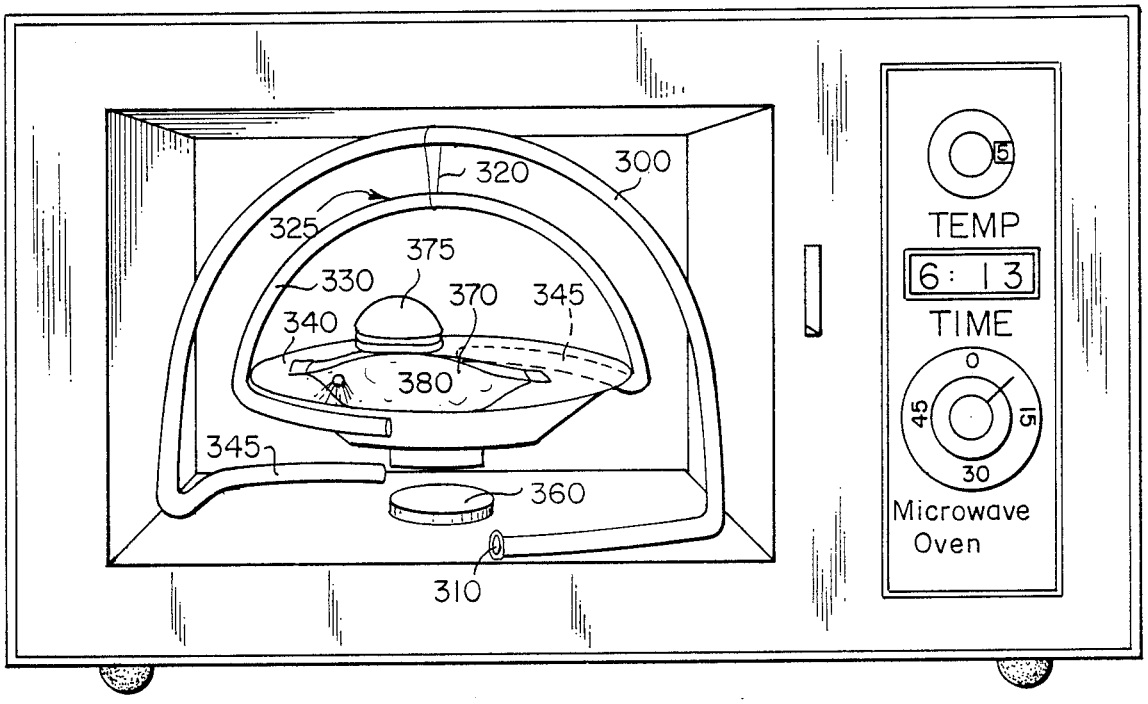
FIG. 3 illustrates a durable and removable apparatus for suspending a variety of items inside a microwave oven to allow complex motion during heating.

Referring to FIG. 3, a fiber support rod 300 may be formed to appear "D" shaped in side view and "S" shaped in plan view. The structure makes a free standing arch from which a food support means may be suspended by a looped fiber 320, for example. Looping the fiber as shown provides two parallel fiber strands that intertwine during rotation. The dual fiber arrangement facilitates the lifting action that occurs during fiber twisting. The arch may be made of thick metal, plastic or ceramic rod or wire and has a generally smooth surface with a minimum of sharp edges. A conductive metal support shows no significant heating following prolonged exposure to the microwave field; it remains substantially at the temperature of the oven'n metal side walls. When a metal arch is coated with a dielectric sheath 310, arcing between it and the oven side walls, which would otherwise occur, is eliminated. The dielectric may be applied by dipping the rod in a polymeric coating material or by sheathing the rod with polyethylene tubing, for example.

Hanging from fiber 320 is a means 325 for supporting a food item to be heated. A tube, rod or wire 330 may be formed to appear "D" shaped in side view and "S" shaped in plan view. The structure forms a "basket handle" for supporting a microwavable glass or ceramic dinner plate 340. Ends 345 of the "S" shaped handle may be bent inwardly to symmetrically engage the underside of a standard dinner plate. A specially formed plate (not shown) having notches on either side for better engaging the handle may also be used. The handle may be tied to the lower end of the fiber to enable chaotic food motion. If the handle includes microwave reflecting material it will alter the standing wave pattern when it rotates and thus form a mode stirrer for more uniform heating. The handle may be coated with a dielectric.

In use, a food item is balanced upon the suspended plate and a motion causing impetus is provided to initiate complex, haphazard, rotary and pendular food motion.

For auxiliary impetus a separate thrust chamber 370 may be suspended along with a food item 375 to be heated. Thrust chamber 370 may be provided in the form of a sealed plastic bag containing a vaporizable working fluid and having a thrust vent 380 formed in the chamber wall. Food item 375 may be placed on top of thrust chamber 370 as shown so that when the chamber expands to provide thrust it lifts the food item into another region of the microwave field. The food item may be placed inside the thrust chamber.

Optionally, a permanent magnet 360 may be provided with plate 340 to further complicate pendular motion as its field interplays with the field of a moving or stationary magnet 365 located beneath the plate, for example. A super conductor in place of magnet 360 may also be provided to assist levitation and unusual motion. The magnets may have opposing fields to assist levitation of the food support in whole or in part. A controllable magnetic field may be provided for interaction with the metal or magnetic portions of the food support to influence any desired motion of the food support.

While there have been described and illustrated several specific embodiments of the invention, it will be clear that variations in the details of the embodiments specifically illustrated and described may be made without departing from the true spirit of the invention as defined in the appended claims.

What is claimed is:

1. A method of heating an item in a microwave oven cavity comprising the steps of:

A. suspending the item away from the walls of said cavity by at least one fiber within the cavity to enable the item to move with a complex motion; and B. applying an impetus to the suspended item to cause item motion; and C. therefore allowing the item to continue its motion during subsequent microwave heating.

2. The method of claim 1, wherein:

said item comprises a quantity of food.

3. The method of claim 1, further comprising:

suspending along with said item a thrust chamber containing a vaporizable fluid and having a gas vent positioned to supply a motion causing thrust vector when said fluid becomes heated, vaporizes and exhausts from said vent.

4. The method of claim 3, wherein:

said thrust chamber envelopes said item.

5. The method of claim 3, wherein:

said thrust chamber is one of a group of containers comprising a plastic bag, a paper bag, a paper and plastic bag, a plastic box, a paper box, and or a paper and plastic box.

6. A method of heating an item in a microwave oven cavity comprising the steps of:

(a) suspending the item at a spaced distance away from the interior walls of said cavity by at least one fiber so as to enable the item to be rotated about a generally vertical axis, (b) causing said at least one fiber and suspended item to rotate about a generally vertical axis, and (c) heating said suspended item with microwaves during at least part of the time that said fiber and item are rotating about a generally vertical axis.

7. A method according to claim 6 wherein said suspended item is caused to rotate by suspending along with said item a thrust chamber containing a vaporizable fluid and having a gas vent positioned to supply a motion causing thrust vector when said fluid becomes heated.

8. A method of heating an item in a microwave oven cavity comprising the steps of (a) suspending the item on a support at a spaced distance away from the interior walls of said cavity by at least one fiber so as to enable the said support to be rotated about a generally vertical axis, (b) causing said at least one fiber and said support to rotate about a generally vertical axis, and (c) heating said suspended item with microwaves during at least part of the time that said fiber and said support are rotating about a generally vertical axis.

9. A method according to claim 8 wherein said suspended item is caused to rotate by including on said support a vaporizable fluid and having a gas vent positioned to supply a motion causing thrust vector when said fluid becomes heated.

* * * * *